United States Patent [19]

Heiberger et al.

[11] Patent Number: 4,559,742

[45] Date of Patent: Dec. 24, 1985

[54] MACHINE FOR VIBRATORY GRINDING OF WORKPIECES

[76] Inventors: Ernst Heiberger, Dürnauer Weg 24, 7326 Heiningen; Franz Heiberger, Schulstrasse 22, 7334 Süssen, both of Fed. Rep. of Germany

[21] Appl. No.: 533,303

[22] Filed: Sep. 19, 1983

[30] Foreign Application Priority Data

Sep. 20, 1982 [DE] Fed. Rep. of Germany ..... 3234819

[51] Int. Cl.[4] ..... B24B 31/06

[52] U.S. Cl. ..... 51/163.1; 51/7

[58] Field of Search ..... 51/163.1, 7

[56] References Cited

U.S. PATENT DOCUMENTS

| | | | |
|---|---|---|---|
| 3,045,397 | 7/1962 | Hesslenberg | 51/7 |
| 3,248,826 | 5/1966 | Van Fossen | 51/7 |
| 3,295,768 | 1/1967 | Moore | 51/163.1 |
| 3,318,051 | 5/1967 | Rampe | 51/163.1 |
| 3,408,774 | 11/1968 | Engel | 51/163.1 |
| 3,449,869 | 6/1969 | Rampe | 51/163.1 |
| 3,496,677 | 2/1970 | Bodine | 51/163.1 |
| 3,694,968 | 10/1972 | Isaacson | 51/163 |
| 3,959,932 | 6/1976 | Rampe | 51/163.1 |

FOREIGN PATENT DOCUMENTS

| | | | |
|---|---|---|---|
| 0667386 | 6/1979 | U.S.S.R. | 51/163.1 |

*Primary Examiner*—Harold D. Whitehead

*Attorney, Agent, or Firm*—LeBlanc, Nolan, Shur & Nies

[57] ABSTRACT

Method for vibratory grinding of workpieces by means of abrasive bodies or the like under the influence of accelerative forces, wherein a homogenous, substantially horizontal stream consisting of workpieces and abrasive bodies is circularly limited in its lateral expansion and is moved as a whole around a substantially horizontal axis. The machine for vibratory grinding of workpieces by means of abrasive bodies or the like, in which the aforementioned method is applied, has a substantially horizontally disposed drum receiving the stream of workpieces and abrasive bodies and being completely filled therewith, being substantially stable in space with respect to rotation and having a circular cross section; this drum is movable in a circular path or the like, wherein the angular velocity of the drum wall around the axis of the drum is substantially "zero"; the drum has an inlet orifice at its one end and at its other end an outlet orifice which is adjustable with respect to its cross-sectional area.

3 Claims, 7 Drawing Figures

MACHINE FOR VIBRATORY GRINDING OF WORKPIECES

The invention refers to a machine for vibratory grinding of workpieces by means of abrasive bodies or the like under the influence of accelerative forces.

In the known vibratory grinding machines, e.g., as shown in U.S. Pat. No. 3,552,068, the workpieces to be treated or ground on their wearing surface are passed together with abrasive bodies of varied geometric shape through an elongated open trough which is caused to vibrate. As a result of the forces upon the workpieces and abrasive bodies caused by the vibrations, the workpiece/abrasive-body mixture moves, on the one hand, longitudinally through the trough and on the other hand, climbs up a wall, to fall back over the developing embankment into the trough when a certain point is reached. In this one must observe that the workpieces reach the surface of the mixture mentioned and in doing so collide with each other, whereby damage to the surfaces occurs. Furthermore, the grinding efficiency is limited due to the construction of the vibratory grinding machine.

The invention is based on the task of treating workpieces to be processed by vibratory grinding with abrasive bodies, such that the workpieces are of a higher quality and the duration of the treatment of the workpieces is shortened, even in the case of workpieces made from very hard material which up to now could not be processed at all, or only under most difficult conditions in treatment requiring much time.

As an object of this invention, the solution of the foregoing task is achieved with a machine for vibratory grinding of workpieces by abrasive bodies or the like, consisting of a drum suspended resiliently relative to a frame by a first set of spring elements, the drum being caused to vibrate by an oscillator which consists of a drive motor and at least one out-of-balance mass. The drum is provided at its two ends with an inlet and outlet for the workpiece/abrasive-body mixture. The machine has the frame suspended resiliently relative to a second foundation frame by a second set or group of spring elements and the substantially horizontal position of the drum, when completely filled with the workpiece/abrasive-body mixture, is adjustable by the provision of resilient bearings embodied as pneumatic spring elements wherein compressed air, controlled by sensor elements is supplied or removed to or from the pneumatic spring elements to accomplish the adjustment.

Further novel features and objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which:

As shown in FIGS. 1 and 2 the vibratory grinding machine includes a drum 11 which rests by means of four claws 72 on pneumatic spring elements 73, which in turn are carried by a frame 74, the frame 74 in turn is mounted by pneumatic spring elements 75 on a frame 76 of support foundation 77. The movement of the drum 11 around an imaginary axis is produced by at least one oscillator located beneath the drum 11 which is made up of a drive motor 71 with at least one unbalanced mass. In this construction it is possible for the drum 11 to be capable of being set in adequate rotary motion without considerable forces acting on the foundation 77. The feed inlet 78 is connected via a flexible hose piece or pipe piece 61 to an inlet pipe connection 62 which is attached tangentially to the upper side and at one end of drum 11. An outlet pipe connection 79 is attached at a tangent to the lower area of and at the other end of the drum 11 and is provided with a stop valve 80 which is movable by a drive cylinder 81, to enable the adjustment of the outlet orifice 82 to a certain value in the desired manner.

Figure 1:
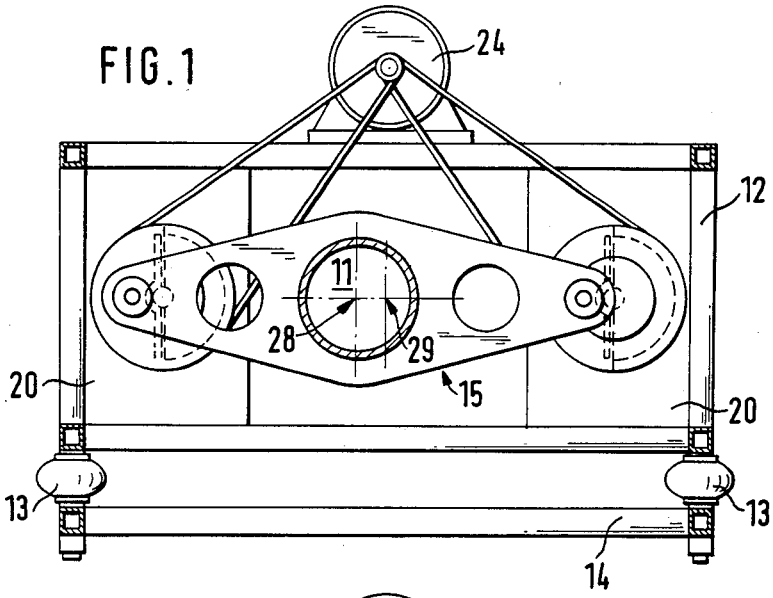
FIG. 1 shows a cross section through vibratory grinding machine in accord with the present invention in which the drum, suspended so as to allow vibration, is moved by a rotating out-of-balance mass
Figure 2:
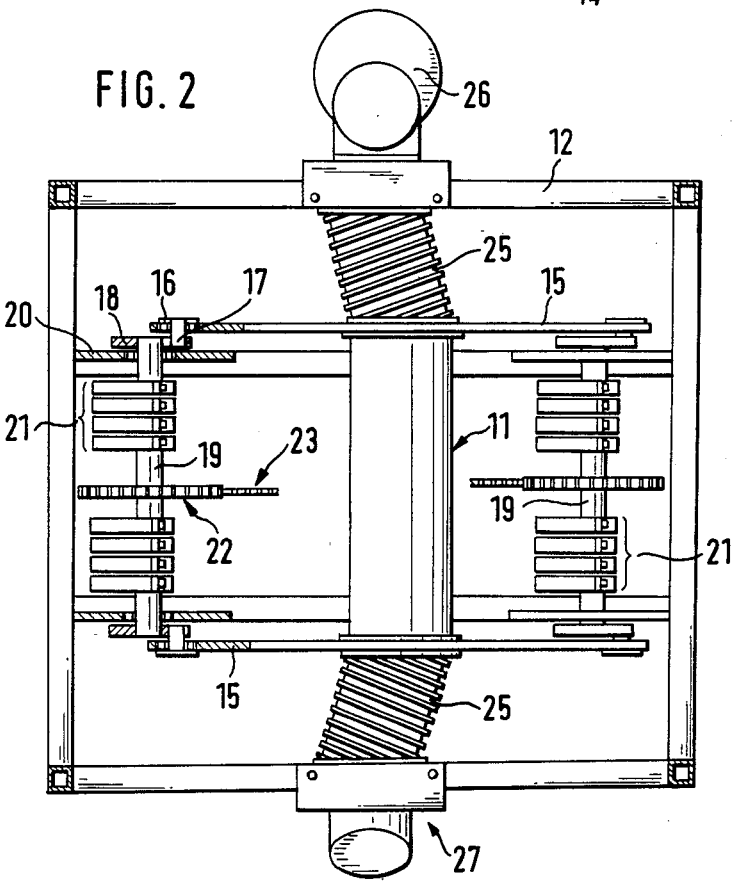
FIG. 2 shows a lateral view of the machine according to FIG. 1.
Figure 3:
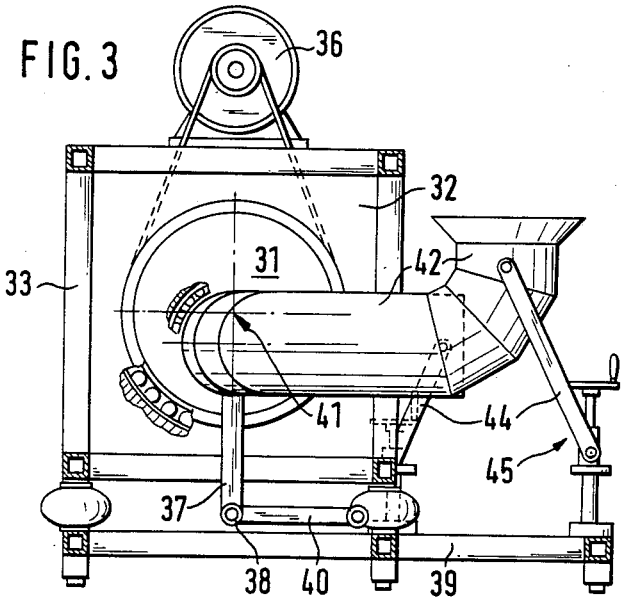
Figure 4:
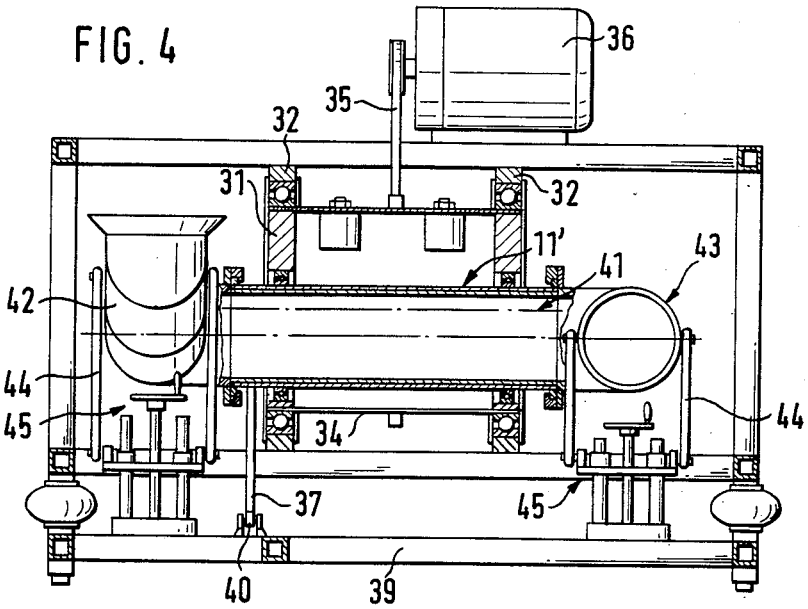
Figure 5:
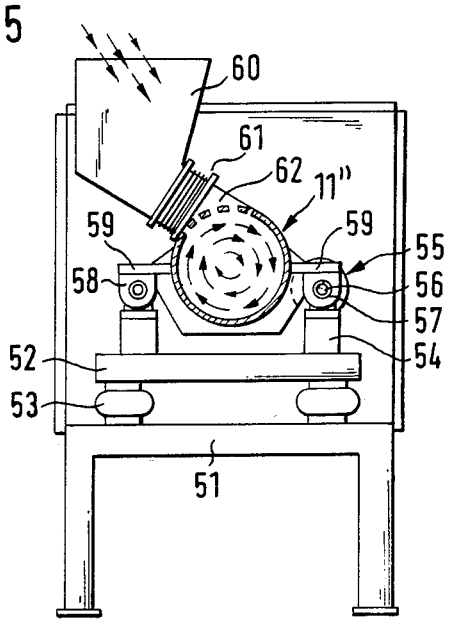
Figure 6:
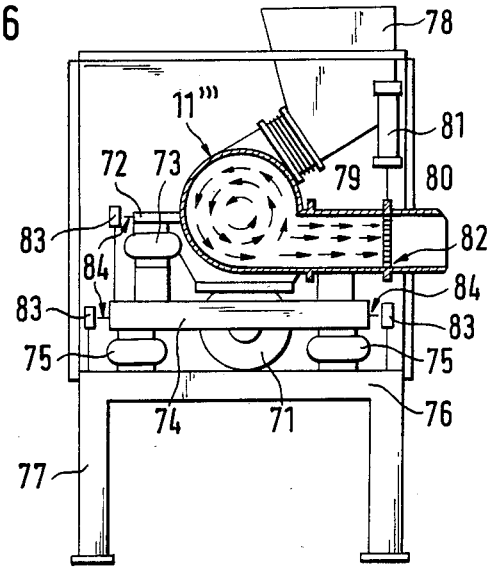
Figure 7:
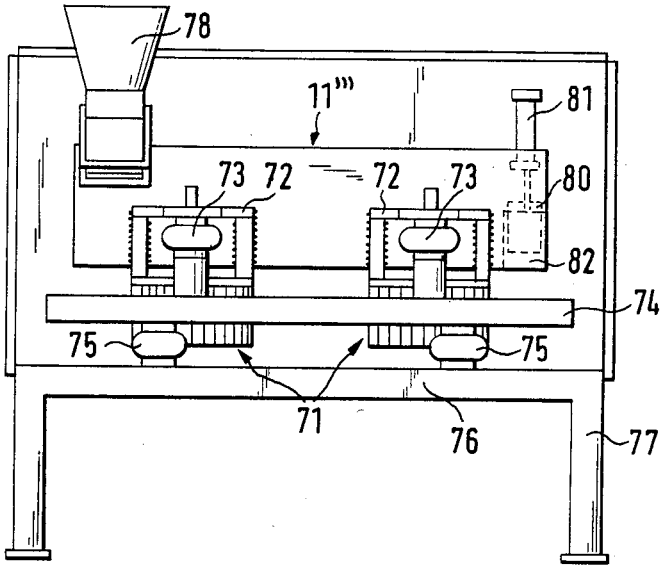

In this machine the important thing is that the drum 11''' always be held in the same, substantially horizontal position in any loading state. This is particularly simple to carry out because one can apply more or less air pressure to the pneumatic spring elements to maintain the desired predetermined position of the drum 11''' or the frame 74. This regulation preferably takes place automatically, for which purpose sensor elements 83, 84 are disposed at certain places on the frames 74 and 76, which sensors control the supplying or release of compressed air to or from the individual pneumatic spring elements 73 and 75.

The vibratory grinding machines designed according to the invention enable extraordinary increases in efficiency relative to that which was previously known, since the acceleration values can be enormously increased with them, as experience has shown. This is only possible if the workpiece/abrasive-body mixture in the working drum completely fills the same, since the accelerative forces can act on the mixture continuously through the drum walls. It has been shown that in these machines, as opposed to all other previously known machines, the workpieces in the mixture are virtually not displaced and do not collide with each other and damage each other, as is to be observed in particular in the treatment of workpieces in open vibratory troughs. The essential advantage of the vibratory grinding machine designed according to the invention, however, lies in the enormous increase in efficiency. This means that workpieces which have been treated up to now in the usual manner require a length of treatment corresponding to a fraction of the former treatment time, wherein, in addition, the quality of the surface treatment is better.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A machine for the vibratory grinding of workpieces by means of abrasive bodies or the like, consisting of a cylindrical drum (11), a first frame (74), first spring elements (73) resiliently suspending said drum to said first frame (74), an oscillator (71), consisting of a drive motor (71) and at least one out-of-balance mass connected to said drum to cause said drum to vibrate, said drum being provided adjacent opposite ends with respective inlet and outlet means for the workpiece and abrasive-body mixture, the improvement comprising: a second frame (76) mounted on a foundation means (77), second spring elements (75) resiliently suspending said first frame to said second frame, said first and said second spring elements being pneumatic spring elements constituting resilient bearings and wherein sensor elements between said drum and said frames determine and control the drum position at a substantially horizontal position of the drum (11) when it is completely filled with the workpiece/abrasive-body mixture by controlling supply or removal of compressed air to or from the pneumatic spring elements (73), (75).

2. A machine according to claim 1, wherein there is a sensor controlling the drum contents in the area of the inlet (78) and regulating the supply of workpieces and abrasive bodies.

3. A machine according to claim 1 or 2, wherein a stop valve (80) is situated in the outlet 79 controlling the outlet orifice (82).

* * * * *